US006206940B1

(12) United States Patent
Weissman et al.

(10) Patent No.: US 6,206,940 B1
(45) Date of Patent: Mar. 27, 2001

(54) FUEL FORMULATIONS TO EXTEND THE LEAN LIMIT (LAW770)

(75) Inventors: Walter Weissman, Basking Ridge; John E. Johnston, Warren; Anthony M. Dean, Hampton, all of NJ (US); Kazuhiro Akihama, Owariasahi (JP); Satoshi Iguchi, Shizuoka-Ken (JP); Shuichi Kubo, Toyoake (JP)

(73) Assignee: Exxon Research and Engineering Company, Florham Park, NJ (US)

( * ) Notice: Subject to any disclaimer, the term of this patent is extended or adjusted under 35 U.S.C. 154(b) by 0 days.

(21) Appl. No.: 09/249,933

(22) Filed: Feb. 12, 1999

(51) Int. Cl.[7] ..... C10L 1/18; C10L 1/06
(52) U.S. Cl. ..... 44/449; 44/447; 44/448
(58) Field of Search ..... 44/447, 448, 449

(56) References Cited

U.S. PATENT DOCUMENTS

| | | | | |
|---|---|---|---|---|
| 3,634,051 | | 1/1972 | Phillips | 44/51 |
| 3,934,566 | | 1/1976 | Ward | 123/119 E |
| 4,081,252 | | 3/1978 | Osborg | 44/53 |
| 4,205,647 | | 6/1980 | Firey | 123/133 |
| 4,312,636 | * | 1/1982 | Singerman | 44/53 |
| 4,378,973 | * | 4/1983 | Sweeney | 44/56 |
| 4,407,661 | | 10/1983 | Dolhyj et al. . | |
| 4,412,847 | * | 11/1983 | Dolhyj et al. | 44/77 |
| 4,519,809 | * | 5/1985 | Hochhauser | 44/53 |
| 4,556,020 | | 12/1985 | Hickling | 123/143 B |
| 4,812,146 | * | 3/1989 | Jessup | 44/77 |
| 4,841,925 | | 6/1989 | Ward | 123/143 B |
| 5,106,389 | * | 4/1992 | Harandi et al. | 44/449 |
| 5,336,278 | * | 8/1994 | Adams et al. | 44/419 |
| 5,354,344 | | 10/1994 | Takizawa et al. | 44/439 |
| 5,380,346 | | 1/1995 | Fritz | 44/401 |
| 5,401,280 | * | 3/1995 | Kaneko et al. | 44/449 |
| 5,632,786 | * | 5/1997 | Basu et al. | 44/448 |
| 5,752,992 | * | 5/1998 | Hendriksen | 44/449 |
| 6,039,772 | * | 3/2000 | Orr | 44/359 |

FOREIGN PATENT DOCUMENTS

| | | | |
|---|---|---|---|
| 0009966 | 4/1980 | (EP) | C10L/1/18 |
| 0053426 | 6/1982 | (EP) | C10L/1/02 |
| 585339 | 2/1947 | (GB) . | |
| 591101 | 8/1947 | (GB) . | |
| 8701384 | 3/1987 | (WO) | C10L/1/18 |
| 9404636 | 3/1994 | (WO) | C10L/10/02 |
| 9533022 | 12/1995 | (WO) | C10L/1/14 |
| 9640844 | 12/1996 | (WO) | C10L/1/02 |

OTHER PUBLICATIONS

Patent Abstracts of Japan, vol. 1997, no. 09, 30 Sept. 1997 (1997–09–30), Akasaka Yukio, Jiyomo Technical Reasearch Center, Pub. No. 09137174, Pub. Date 27–05–97, C10L 1/06, *Gasoline.*

Patent Abstracts of Japan –Pub. No. 06192667, Pub. Date: 12–7–94, Yokoyama Nobuo, Nippon Oil Co. Ltd. Int. Cl. C10L 1/18, *Gasoline Composition.*

* cited by examiner

*Primary Examiner*—Ellen M. McAvoy
(74) *Attorney, Agent, or Firm*—Paul E. Purwin

(57) ABSTRACT

The invention is related to fuels having a high laminar flame speed and particular distillation characteristics. More particularly, the invention is directed towards fuels containing at least one species having a laminar flame speed greater than isooctane's laminar flame speed and specific distillation characteristics including $T_{50}$, FBP, IBP.

67 Claims, 3 Drawing Sheets

FUEL FORMULATIONS TO EXTEND THE LEAN LIMIT (LAW770)

FIELD OF THE INVENTION

The invention is related to fuels for extending the lean burn limit in internal combustion engines. More particularly, the invention is directed towards fuels containing at least one species having a high laminar flame speed and specific distillation characteristics. The fuel permits operation of lean burn engines at lower lean burn limits resulting in fuel economy gains and emissions reduction.

BACKGROUND

One of the most important recent advances in spark ignition engines involves operation under lean conditions at low to moderate load to achieve fuel economy gains. Significant technological developments have been made in engine design and configuration to facilitate operation under lean conditions. Spark ignition engines are capable of operating with known fuels at a normalized fuel to air ratio ("Φ") below 1.0. The normalized fuel to air ratio is the actual fuel to air ratio divided by the stoichiometric fuel to air ratio. The Φ at which an engine begins to exhibit unacceptable torque fluctuations is called the "lean limit". Still further fuel economy improvement in such engines may be achieved and $NO_x$ emissions reduced by operating the engine with a fuel capable of extending the engine's lean limit.

Fuel economy gains in these lean burn engines are typically realized during operation at low and moderate load; however at high load, these engines operate at a Φ of about 1, requiring that the fuel meet octane and other standard fuel specifications. Accordingly, to have practical application, the fuel of the present invention must meet octane and other standard fuel specifications.

Cold engine startup is a known source of problematic engine emissions. Spark injected ("SI") engines, lean burn or conventional, effectively operate under partially lean conditions during cold startup because of incomplete fuel vaporization. Lean limit improvements during cold engine start up would beneficially lower hydrocarbon emissions by reducing the fueling requirement for effective combustion.

There is therefore a need for a fuel that meets standard fuel specifications and is capable of extending the lean limit of engines. The fuel of this invention meets these needs.

SUMMARY OF THE INVENTION

In one embodiment, the invention is a fuel comprising an effective amount of at least one species having a laminar flame speed greater than isooctane's laminar flame speed, laminar flame speed being measured at a Φ ranging from about 0.4 to about 0.8, and fuel distillation/volatility characteristics including: $T_{50}$ less than about 77° C. Final Boiling Point less than about 160° C., Initial Boiling Point greater than about 32° C. In another embodiment, the invention is a method for reducing Φ in a liquid fueled, port-injected engine without increasing torque fluctuations. The invention may concurrently reduce $NO_x$ by allowing the engine to operate at a lower lean limit.

The high laminar flame speed species of the present invention may be selected from the group consisting of

R1—O—R2, R1—C=C—R2,

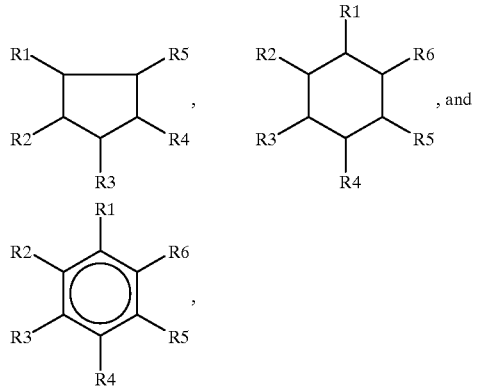

and mixtures thereof, wherein R1, R2, R3, R4, R5, and R6 are independently selected from the group consisting of H, linear, branched, cyclo alkyl, and aryl or alkyl aryl, provided that the species has a total number of carbon atoms ranging from about 5 to about 12, and provided that when the species is

R1—O—R2 that both R1 and R2 are hydrocarbyl and the total number of carbon atoms in the species ranges from about 7 to about 12.

In still another embodiment, the invention is a fuel for use in a port fuel-injected engine with a Φ ranging under low load conditions from about 0.4 to about 0.8 and with torque fluctuations less than about 0.6 N-m.

DETAILED DESCRIPTION OF THE INVENTION

Figure 1:
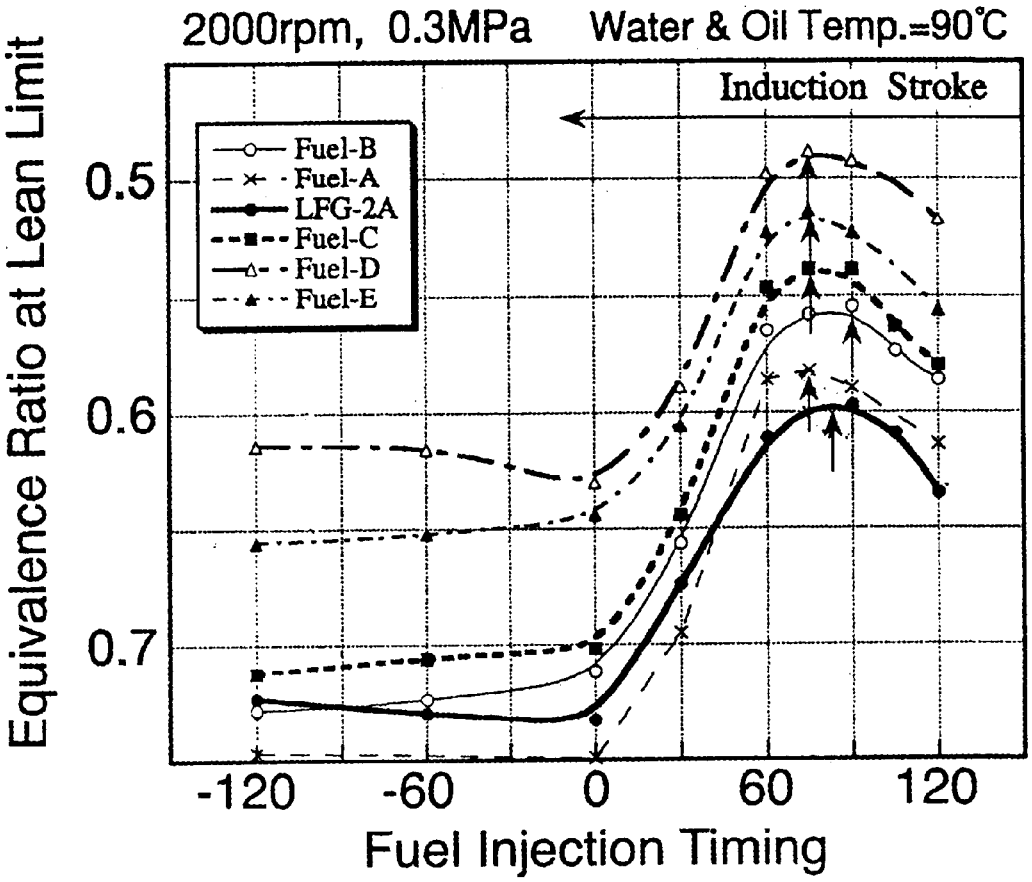
FIG. 1 shows the variation in equivalence ratio at the lean limit for several injection timings for fuels having different laminar flame speeds and distillation characteristics.

The invention is based on the discovery that an engine's lean limit can be extended to a lower Φ by operating the engine with a fuel having specific distillation characteristics and an effective amount of at least one species having a high laminar flame speed. Controlling both the distillation characteristics of the fuel and laminar flame speed characteristics of the species within the fuel results in a fuel which extends the lean limit in internal combustion engines. The lower lean limit results in greater fuel economy. Using such a fuel also decreases emissions of $NO_x$ by enabling engine operation at a lower Φ.

While the fuel may be in any phase, the preferred fuel is a liquid fuel preferably used in a spark ignition. More preferably, the fuel is a blend of gasoline and at least about 10 vol. %, of species with a laminar flame speed greater than isooctane. The invention is compatible with substantially all gasolines, and blends within the invention meet octane, stability, and other standard gasoline specifications.

As stated above, one characteristic of the fuel is a species having a laminar flame speed greater than isooctane. Laminar flame speed is measured by combustion-bomb techniques that are well known in the art. See, for example, M. Metghalchi and J. C. Keck, Combustion and Flame, 38: 143–154 (1980).

The high flame speed species of the present invention is selected from the group consisting of

R1—O—R2, R1—C═C—R2,

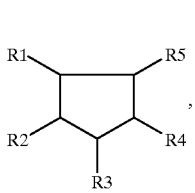

,

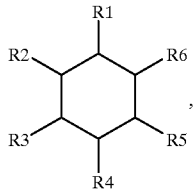

, and

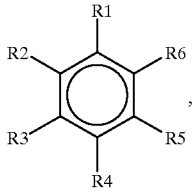

, wherein R1, R2, R3, R4, R5, and R6 are independently selected from the group consisting of H, linear, branched, or cyclo alkyl, and aryl or alkyl aryl, provided that the species has a total number of carbon atoms ranging from about 5 to about 12, and provided that when the species is

R1—O—R2 that both R1 and R2 are hydrocarbyl and the total number of carbon atoms in the species ranges from about 7 to about 12. The normal boiling points of the high flame speed species range from about 35° C. to about 225° C.; in an alternate embodiment, the normal boiling points range from about 75° C. to about 225° C.

The laminar flame speed of some species useful in the invention, relative to isooctane's laminar flame speed, is set forth in Table 1 along with their normal boiling points in ° C. These laminar flame speeds were measured in a combustion bomb at Φ=0.6. It should be noted that the listed species have relatively low toxicity, high thermal stability, and satisfactory octane numbers, (i.e., motor octane number, "MON">75, research octane number "RON">80).

TABLE 1

| | cyclopentane | pentene-2 | toluene | cyclohexane | anisole |
|---|---|---|---|---|---|
| Laminar Flame Speed Relative to Isooctane | 1.06 | 1.29 | 1.4 | 1.42 | 1.57 |
| Normal Boiling Point | 49 | 37 | 110 | 81 | 154 |

A fuel may contain a species that has a relatively high laminar flame speed (i.e., exceeding that of isooctane), but may not exhibit an improved lean limit. Accordingly, this invention teaches the combination of a high flame speed species and specific overall fuel distillation characteristics.

The distillation characteristics which are used herein to describe the fuel of this invention are $T_{50}$, Initial Boiling Point ("IBP"), and Final Boiling Point ("FBP"), all of which are measured in accordance with ASTM specification D86. The overall fuel has a $T_{50}$ less than about 77° C. In alternative embodiments, $T_{50}$ is less than about 70° C., 65° C., 60° C., 55° C. and about 50° C. The overall fuel has a final boiling point (FBP) less than about 160° C. In alternate embodiments, FBP is less than about 155° C., 150° C., 145° C., 130° C., 115° C., and 100° C. The overall fuel has an initial boiling point (IBP) greater than about 32° C. In a preferred embodiment the IBP is greater than about 35° C., and in alternate embodiments the IBP is greater than about 40° C. and 45° C.

While not wishing to be bound, and although not fully evaluated, it is understood that fuels having distillation characteristics outside the ranges taught herein, result in an extended initial burn, a delayed final burn or some combination thereof. Fuel blends having an IBP contrary to this invention may be swept out of the spark plug region by incoming gas flow, causing a depletion of the local fuel:air ratio at time of ignition near the spark, all of which contribute to poor or poorer lean limit performance. It is believed that the combination of laminar flame speed and distillation characteristics, as taught herein, result in improved lean limit.

In one embodiment, the fuel of this invention may contain oxygenate. However, the oxygenate is also selected to enhance (or at least not detract from) the fuel's lean limit performance. Oxygen containing species such as ethanol or methyl-tert-butyl ether, or certain other relatively volatile oxygen containing compounds, will have the disadvantage of creating a fuel:air mixture, in the region of the spark plug, whose local Φ is lower than the overall average. This may result in poorer ignition characteristics and a lower initial flame speed. Therefore, whenever oxygen of this nature is used, that oxygen content it is limited to less than 2.6% by weight and preferably less than about 2%. Accordingly, whenever the fuel of the present invention contains oxygen from an oxygen containing species described below, that species is limited to about 2.6 wt. % or less and preferably about 2.0 wt. % or less. The oxygen species limited to 2.6 wt. % or less is defined as:

R1—O—R2 where $R_1$ and $R_2$ are independently selected from the group consisting of H, linear, branched cyclo alkyl, and aryl or alkyl aryl, and the total number of carbon atoms range from about one to about six.

The invention is more particularly set forth in the following examples.

EXAMPLES

The following measurements were conducted using five fuel blends, "A" through "E", in a lean burn, port injected engine. The compositions of fuels A through E and laminar flame speed (Φ=0.6) are set forth in Table 2. These laminar flame speeds were determined by measuring the laminar flame speed of the component species of each fuel and linearly blending these values on a weight percent basis. These flame speed measurements were performed in a constant volume combustion bomb at Φ=0.6 according to the technique described in M. Metghalchi and J. C. Keck. Combustion and Flame, 38:143–154 (1980) with argon substituted for nitrogen in air. In addition to these, a reference conventional gasoline fuel (LFG2A) was included in the engine test set for comparison purposes. The properties of the reference fuel were: ASTM $T_{50}$=100° C., FBP=176° C. IBP=31.0° C.; RON=91.4; and MON=82.4. Compositionally, the reference fuel contained 64% saturates, 8% olefins, 29% aromatics, and all by vol. %.

TABLE 2

| FUEL | A | B | C | D | E | LFG2 A |
|---|---|---|---|---|---|---|
| ASTM DISTILLATION | | | | | | |
| IBP | 44 | 41.5 | 38.5 | 32.5 | 37.5 | 31.0 |
| $T_{50}$ ° C. | 72 | 70 | 56 | 47 | 61 | 100 |
| FBP ° C. | 105.5 | 107.5 | 94.5 | 151 | 150.5 | 176 |
| FUEL COMPOSITION VOL % | | | | | | |
| Isopentane | 14.4 | 14.4 | 14.4 | 14.4 | | |
| Pentene-2 | | | 30 | 50 | 50 | |
| Cyclopentane | | 19.6 | 19.6 | | | |
| 2-Methylpentane | 39.6 | | | | | |
| 4-Methyl-1-Pentene | 10 | 10 | | | | |
| Cyclohexane | | 43 | 30 | | 30 | |
| Isooctane | 23 | | 3 | | | |
| Toluene | 13 | 13 | 3 | | | |
| Anisole | | | | 35.6 | 20 | |
| Sulfur Content, ppm | <50 | <50 | <50 | <50 | <50 | >70 |
| RON/MON | 89.9/80.8 | 93.6/82.7 | 85.0/81.7 | 100.5/85.7 | 95.8/80.6 | |
| LAMINAR FLAME SPEED @ .6 PHI, RELATIVE TO IC8 | 1.10 | 1.29 | 1.29 | 1.39 | 1.41 | |

A commercially available lean burn engine was operated at steady state on a bench dynamometer at representative low load conditions (2000 rpm, 0.3 Mpa BMEP, water and oil temperature=90° C.) over a range of fuel injection timings and fuel/air ratios, which includes fuel injection synchronization with intake valve open as well as closed. At each operating point the spark advance was adjusted to give minimum fuel consumption (i.e., MBT, maximum brake torque timing). The lean limit was determined in each test by measuring the torque fluctuation as the fuel/air ratio was decreased until torque fluctuations increased to 0.6 Nm. Significant improvements in the lean limit were achieved with fuels B through E as compared with either Fuel A or LFG2A across the range of fuel injection timings where the lean limit was best minimized. These data are summarized in Table 3.

TABLE 3

| Fuel | Minimum Equivalence ratio at lean limit | Fuel Injection Timing* for minimum phi |
|---|---|---|
| A | 0.58 | 75 |
| B | 0.56 | 90 |
| C | 0.54 | 75 |
| D | 0.48 | 75 |
| E | 0.52 | 75 |
| LFG2A | 0.60 | 80 |

*Crank Angle Degrees (CAD) After Top Dead Center when injection complete

Each of the fuels had approximately the same spark advance (50±2° CAD) at the lean limit. This is an indication that the burn durations at the lean limit were approximately the same because earlier timings for MBT are normally required if the burn duration is longer.

Figure 2:
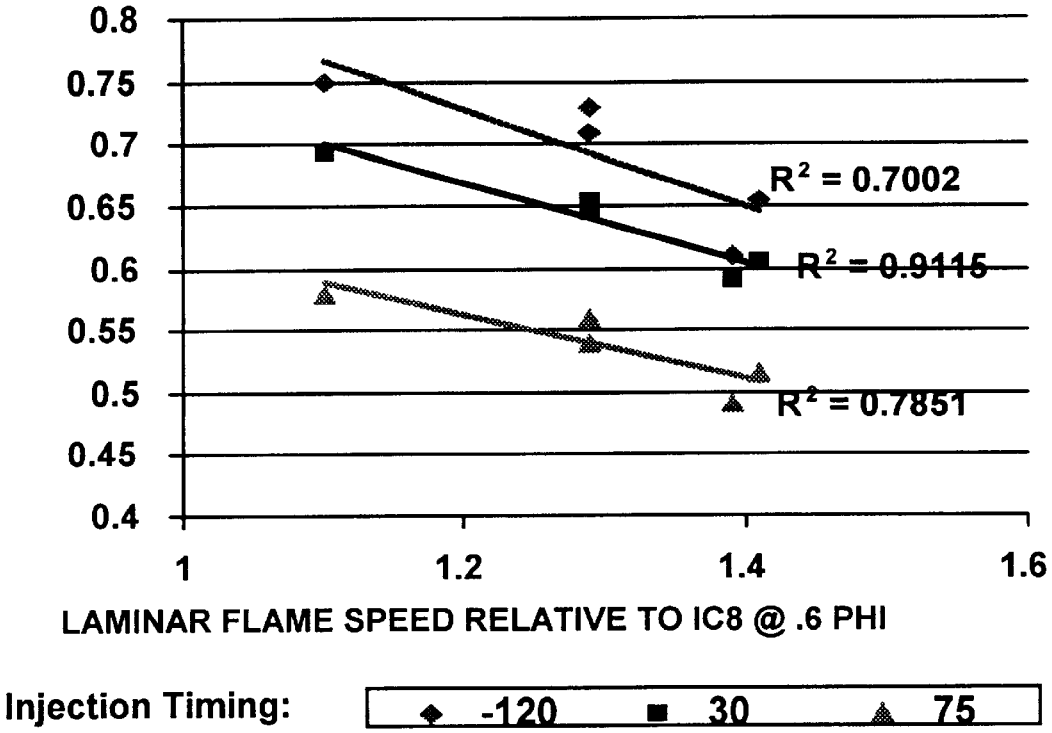
FIG. 2 shows the variation of lean limit with relative laminar flame speeds measured at a phi of 0.6 for five of the fuels of Table 2.

The lean limits for fuels A through E were found to correlate to their laminar flame speeds. This is illustrated in FIG. 2. All laminar flame speeds are expressed relative to the burn rate of fuel A. These values have been corrected for differences in in-cylinder conditions at a given percent burn versus the in-cylinder conditions for fuel A.

Burn rate curves at a Φ=0.66 were measured for all six fuels; the results are shown in Table 4 for 50, 75 and 90% burns. It is well known that laminar flame speeds as measured in accordance with this invention correlate with engine burn rates. See for example "The Nature of Turbulent Flame Propagation in a Homogeneous Spark Ignited Engine" by Edward G. Groff and Frederic A. Matekunas SAE Paper 800133). This known correlation is generally followed in Table 4 for fuels A through E. Table 4 also identifies measured burn rates for the reference fuel LFG2A. It has an intermediate burn rate, which, based on well-established correlations known in the art, would have an intermediate laminar flame speed. However, as indicated in Table 3, it has the poorest lean limit.

TABLE 4

| Fuel | Burn Rate (% per CAD) at 50% Burn | Burn Rate (% per CAD) at 75% Burn | Burn Rate (% per CAD) at 90% Burn | CAD For 0–2.5% Initial Burn |
|---|---|---|---|---|
| A | 3.1 | 2.1 | 0.6 | 21 degrees |
| B | 3.2 | 2.4 | 0.9 | 18 degrees |
| C | 3 | 2 | 0.8 | 19 degrees |
| D | 3.7 | 2.8 | 1.4 | 17 degrees |
| E | 3.8 | 2.9 | 1.5 | 17 degrees |
| LGF2A | 3.2 | 2.4 | 1.1 | 26 degrees |

Table 4 also shows the crank angle duration for establishing the first 2.5% of the burn for all six fuels (the inverse of the average burn rate). The total duration of this portion of the burn is about 20 crank angle degrees, representing about 25% of the total burn duration, for the A–E fuels. The LFG2A fuel initial burn duration, however, is significantly longer, being about 26 crank angle degrees.

Figure 3:
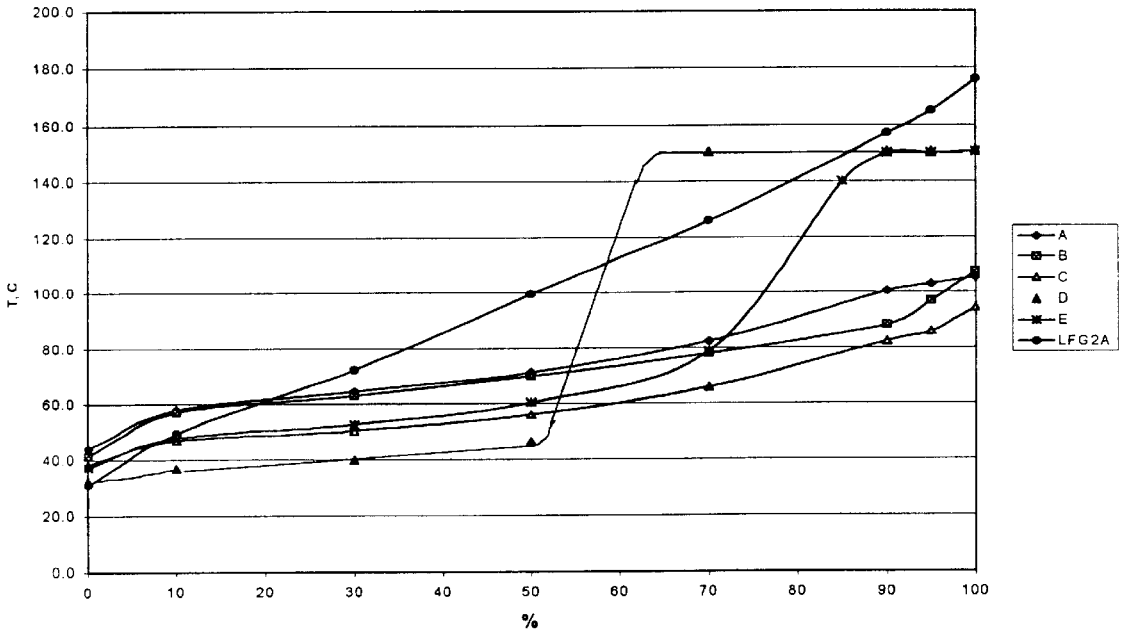
FIG. 3 shows the distillation curves for all of the fuels of Table 2.

While not wishing to be bound, it is believed that the longer initial burn duration for LFG2A results in poorer lean limit performance compared with the other five fuels. It is believed that the relatively poor lean limit performance results from the distillation characteristic differences between the LFG2A fuel and the other five fuels, as can be seen from the comparison of the distillation curves of all six fuels shown in FIG. 3.

What is claimed is:

1. A fuel comprising at least one species having a laminar flame speed greater than isooctne's laminar flame speed, laminar flame speed being measured at a Φ ranging from about 0.4 to about 0.8, said fuel having a $T_{50}$ less than about 77° C., a FBP less than about 160° C., an IBP greater than about 320° C., and less than about 2.6 weight percent of oxygen from an oxygen containing species defined as follows:

R1—O—R2

Where R1 and R2 are independently selected from the group consisting of H, linear, branched, cyclo alkyl, and aryl or alkyl aryl, and the total number of carbon atoms range from about one to about six wherein the total said species comprises greater than about ten percent (10%) of the fuel.

2. The fuel of claim 1 wherein the species is selected from the group consisting of

R1—O—R2, R1—C=C—R2,

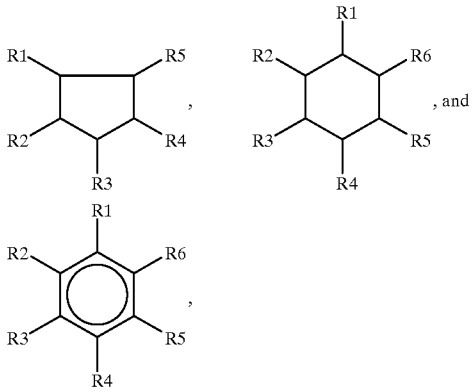

and mixtures thereof, wherein R1, R2, R3, R4, R5, and R6 are independently selected from the group consisting of H, linear, branched, cyclo alkyl, and aryl or alkyl aryl, provided that the species has a total number of carbon atoms ranging from about 5 to about 12, and provided that when the species is

R1—O—R2 that both R1 and R2 are hydrocarbyl and the total number of carbon atoms in the species ranges from about 7 to about 12.

3. The fuel of claim 2, wherein the species is selected from the group consisting of cyclopentane, pentene-2, toluene, cyclohexane, anisole, and mixtures thereof.

4. The fuel of claim 2, wherein the species is present in an amount ranging from 10% to 99% based on the fuel's liquid volume and the fuel's laminar flame speed is greater than isooctane's laminar flame speed.

5. The fuel of claim 4 wherein the species has a normal boiling point ranging from about 35° C. to about 225° C. and a motor octane ranging from about 70 to about 110.

6. The fuel of claim 5 wherein the species has a normal boiling point ranging from about 75° C. to about 225° C. and a motor octane ranging from about 70 to about 110.

7. The fuel of claim 6, further comprising gasoline.

8. The fuel of claim 7, wherein the gasoline is an unleaded gasoline.

9. The fuel of claim 8, wherein the fuel ranges in research octane number from about 80 to about 120 and motor octane ranges from about 70 to about 110.

10. The fuel of claim 1, wherein said $T_{50}$ is less than about 70° C.

11. The fuel of claim 10, wherein said $T_{50}$ is less than about 65° C.

12. The fuel of claim 11, wherein said $T_{50}$ is less than about 60° C.

13. The fuel of claim 12, wherein said $T_{50}$ is less than about 55° C.

14. The fuel of claim 13, wherein said $T_{50}$ is less than about 50° C.

15. The fuel of claim 1, wherein said FBP is less than about 155° C.

16. The fuel of claim 15, wherein said FBP is less than about 150° C.

17. The fuel of claim 16, wherein said FBP is less than about 145° C.

18. The fuel of claim 17, wherein said FBP is less than about 130° C.

19. The fuel of claim 18, wherein said FBP is less than about 115° C.

20. The fuel of claim 19, wherein said FBP is less than about 100° C.

21. The fuel of claim 1, wherein said IBP is greater than about 35° C.

22. The fuel of claim 21, wherein said IBP is greater than about 40° C.

23. The fuel of claim 22, wherein said IBP is greater than about 45° C.

24. A method for reducing phi in a liquid fueled, port-injected engine without increasing torque fluctuations, comprising adding in the fuel at least one species having a laminar flame speed greater than isooctane's laminar flame speed, laminar flame speed being measured at a Φ ranging from about 0.4 to about 0.8, said fuel having a $T_{50}$ less than about 77° C., a FBP less than about 160° C., and IBP greater than about 32° C., and an oxygen content less than about 2.6 weight percent of oxygen from an oxygen containing species defined as.

R1—O—R2 where R1 and R2 are independently selected from the group consisting of H, linear, branched, cyclo alkyl, and aryl or alkyl, aryl, and the total number of carbon atoms range from about one to about six wherein the total of said species comprises greater than about ten percent (10%) of the fuel.

25. The method of claim 24, wherein the species are selected from the group consisting of

R1—O—R2, R1—C=C—R2,

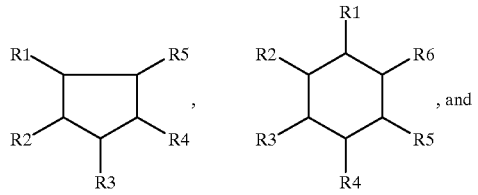

-continued

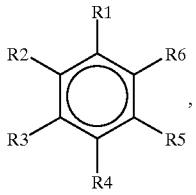

and mixtures thereof, wherein R1, R2, R3, R4, R5, and R6 are independently selected from the group consisting of H, linear, branched, cyclo alkyl, and aryl or alkyl aryl, provided that the species has a total number of carbon atoms ranging from about 5 to about 12, and provided that when the species is

R1—O—R2 that both R1 and R2 are hydrocarbyl and the total number of carbon atoms in the species ranges from about 7 to about 12.

26. The method of claim 25, wherein the species is selected from the group consisting of cyclopentane, pentene-2, toluene, cyclohexane, anisole, and mixtures thereof.

27. The method of claim 25, wherein the species is present in an amount ranging from 10% to 99% based on the fuel's liquid volume and the fuel's laminar flame speed is greater than isooctane's laminar flame speed.

28. The method of claim 27, wherein the species has a normal boiling point ranging from about 35° C. to about 225° C. and a motor octane ranging from about 70 to about 110.

29. The method of claim 28, wherein the species has a normal boiling point ranging from about 75° C. to about 225° C. and a motor octane ranging from about 70 to about 110.

30. The method of claim 24, wherein said $T_{50}$ is less than about 70° C.

31. The method of claim 30, wherein said $T_{50}$ is less than about 65° C.

32. The method of claim 31, wherein said $T_{50}$ is less than about 60° C.

33. The method of claim 32, wherein said $T_{50}$ is less than about 55° C.

34. The method of claim 33, wherein said $T_{50}$ is less than about 50° C.

35. The method of claim 24, wherein said FBP is less than about 155° C.

36. The method of claim 35, wherein said FBP is less than about 150° C.

37. The method of claim 36, wherein said FBP is less than about 145° C.

38. The method of claim 37, wherein said FBP is less than about 130° C.

39. The method of claim 38, wherein said FBP is less than about 115° C.

40. The method of claim 39, wherein said FBP is less than about 100° C.

41.The method of claim 24, wherein said IBP is greater than about 35° C.

42. The method of claim 41, wherein said IBP is greater than about 40° C.

43. The method of claim 42, wherein said IBP is greater than about 45° C.

44. A fuel for extending the lean burn limit in internal combustion engines, said fuel comprising a blend of constituents having a $T_{50}$ less than about 77° C., FBP less than about 160° C., an IBP greater than about 32° C., and less than about 2.6 weight percent of oxygen from an oxygen containing species defined as follows:

R1—O—R2 where $R_1$ and $R_2$ are independently selected from the group consisting of H, linear, branched cyclo alkyl, and aryl or alkyl aryl, and the total number of carbon atoms range from about one to about six.

45. The fuel of claim 44, wherein the fuel has a $T_{50}$ less than about 70° C.

46. The fuel of claim 45, wherein the fuel has a $T_{50}$ less than about 65° C.

47. The fuel of claim 46, wherein said fuel has a $T_{50}$ less than about 60° C.

48. The fuel of claim 47, wherein said fuel has a $T_{50}$ less than about 55° C.

49. The fuel of claim 48, wherein said fuel has a $T_{50}$ less than about 50° C.

50. The fuel of claim 44, wherein the fuel has an IBP greater than about 35° C.

51. The fuel of claim 50, wherein said IBP is greater than about 40° C.

52. The full of claim 51, wherein said IBP is greater than about 45° C.

53. The fuel of claim 44, wherein said FBP is less than about 155° C.

54. The fuel of claim 53, wherein said FBP is less than about 150° C.

55. The fuel of claim 54, wherein said FBP is less than about 145° C.

56. The fuel of claim 55, wherein said FBP is less than about 130° C.

57. The fuel of claim 56, wherein said FBP is less than about 115° C.

58. The fuel of claim 57, wherein said FBP is less than about 100° C.

59. The fuel of claim 44, wherein the fuel contains at least one species selected from the group consisting of

R113 O—R2, R1—C═C—R2,

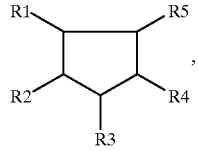

,

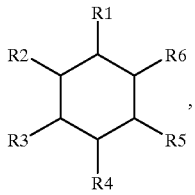

, and

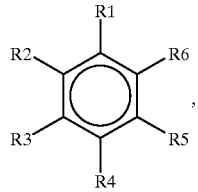

, and mixtures thereof, wherein R1, R2, R3, R4, R5, and R6 are independently selected from the group consisting of H, linear, branched, or cyclo alkyl, and aryl or alkyl aryl, provided that the species has a total number of carbon atoms ranging from about 5 to about 12, and provided that when the species is

R1—O—R2 that both R1 and R2 are hydrocarbyl and the total number of carbon atoms in the species ranges from about 7 to about 12.

60. The fuel of claim 59, wherein the species is selected from the group consisting of cyclopentane, pentene-2, toluene, cyclohexane, anisole, and mixtures thereof.

61. The fuel of claim 59, wherein the species is present in an amount ranging from about 10% to about 99% based on the fuel's liquid volume.

62. The fuel of claim 61, wherein the species has a motor octane number ranging from about 70 to about 110 and has a flame speed greater than isooctane's flame speed, the species' flame speed and isooctane's flame speed both being measured at a $\Phi$ ranging from about 0.4 to about 0.8 and at an unburned gas temperature ranging from about 450° to about 700° Kelvin.

63. The fuel of claim 62, further comprising gasoline.

64. The fuel of claim 63, wherein the gasoline is an unleaded gasoline.

65. The fuel of claim 64, wherein the fuel ranges in research octane number from about 80 to about 120 and motor octane ranges from about 70 to about 110° C.

66. A method for concurrently extending lean burn limit in, and reducing the emissions from, an internal combustion engine, by operating said engine on a fuel having a $T_{50}$ less than about 77° C., a FBP less than about 160° C., an IBP greater than about 32° C., and a sulfur content less than about 130 ppm, and an oxygen content less than about 2.6 weight percent of oxygenate from an oxygen containing species defined as follows:

R1—O—R2 where $R_1$ and $R_2$ are independently selected from the group consisting of H, linear, branched cyclo alkyl, and aryl or alkyl aryl, and the total number of carbon atoms range from about one to about six.

67. A fuel for concurrently extending lean burn limit in, and reducing the emissions from, an internal combustion engine, by operating said engine on a fuel having a $T_{50}$ less than about 77° C., a FBP less than about 160° C., an IBP greater than about 32° C., and a sulfur content less than about 70 ppm, and an oxygen content less than about 2.6 weight percent of oxygenate from an oxygen containing species defined as follows:

R1—O—R2 where $R_1$ and $R_2$ are independently selected from the group consisting of H, linear, branched cyclo alkyl, and aryl or alkyl aryl, and the total number of carbon atoms range from about one to about six.

* * * * *

UNITED STATES PATENT AND TRADEMARK OFFICE

CERTIFICATE OF CORRECTION

PATENT NO. : 6,206,940 B1
DATED : March 27, 2001
INVENTOR(S) : Weissman et al.

It is certified that error appears in the above-identified patent and that said Letters Patent is hereby corrected as shown below:

Title page,
Item [73], Assignee, should include the following:
-- Toyota Motor Corporation, Shizuoka (JP) --; and -- Toyota Central Research and Development Laboratories, Inc., Aichi (JP) --.

Signed and Sealed this

Eighteenth Day of May, 2004

JON W. DUDAS
*Acting Director of the United States Patent and Trademark Office*